US005263713A

United States Patent [19]

Taylor et al.

[11] Patent Number: 5,263,713

[45] Date of Patent: Nov. 23, 1993

[54] GOLF CLUB HEAD

[75] Inventors: Douglas P. Taylor, N. Tonawanda; Paul L. Tuttobene, Pittsford, both of N.Y.

[73] Assignee: Tayco Developments, Inc., North Tonawanda, N.Y.

[21] Appl. No.: 931,051

[22] Filed: Aug. 17, 1992

[51] Int. Cl.[5] ..... A63B 53/04

[52] U.S. Cl. ..... 273/78; 273/170; 273/DIG. 29; 273/167 H

[58] Field of Search ..... 273/78, 170, 167 H, 273/162 R, 175, 167 J, 167 C, 167 F, 169, DIG. 29

[56] References Cited

U.S. PATENT DOCUMENTS

| | | | |
|---|---|---|---|
| 769,939 | 9/1904 | Clark | 273/78 |
| 3,387,844 | 6/1968 | Shippee | 273/78 X |
| 3,993,314 | 11/1976 | Harrington et al. | 273/170 |
| 4,170,357 | 10/1979 | Greer | 273/167 R |
| 4,591,160 | 5/1986 | Piragino | 273/167 R |
| 4,655,458 | 4/1987 | Lewandowski | 273/170 |
| 4,988,104 | 1/1991 | Shiotani et al. | 273/167 H |
| 5,028,049 | 7/1991 | McKeighen | 273/167 H |
| 5,064,197 | 11/1991 | Eddy | 273/167 H |
| 5,122,324 | 6/1992 | Yong-Sup | 273/167 H X |

FOREIGN PATENT DOCUMENTS

| | | | |
|---|---|---|---|
| 124401 | 5/1947 | Australia | 273/78 |
| 225938 | 2/1959 | Australia | 273/170 |
| 2247628 | 3/1992 | United Kingdom | 273/167 H |

*Primary Examiner*—George J. Marlo
*Attorney, Agent, or Firm*—Joseph P. Gastel

[57] ABSTRACT

A golf club heat consisting of a completely closed hollow metal body, a yieldable ball striking face on the hollow body, a pressurized compressible silicone fluid in the follow body, a hosel connected to the hollow metal body, a threaded port in the hosel through which the silicone fluid is placed in the hollow body, and a sealing plug in the threaded port.

12 Claims, 1 Drawing Sheet

GOLF CLUB HEAD

BACKGROUND OF THE INVENTION

The present invention relates to an improved golf club head.

There are two basic types of "wood" golf club heads commonly in use. One type is the solid wood type and the other type is the hollow metal type, which is known as a "metal-wood." Of the wood types, the persimmon type has always been considered the best. It is believed that the advantage of the persimmon wood was the hardness and density of the solid hard wood striking and oblonging the ball. However, it is believed that this club had the disadvantage of a very small "sweet spot." The metal wood is believed to have a large "sweet spot" but is believed to provide an overall shorter drive distance due to the hollow head.

SUMMARY OF THE INVENTION

It is the primary object of the present invention to provide a metal wood filled with a compressed fluid which causes the metal wood to in effect act as a liquid spring, thereby providing the dual advantages of both an increased size "sweet spot" and longer drives. Other objects and attendant advantages of the present invention will readily be perceived hereafter.

The present invention relates to a golf club head comprising a completely closed hollow body, a yieldable ball striking face on said hollow body, and a pressurized compressible fluid in said hollow body.

The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5, 6, 7:
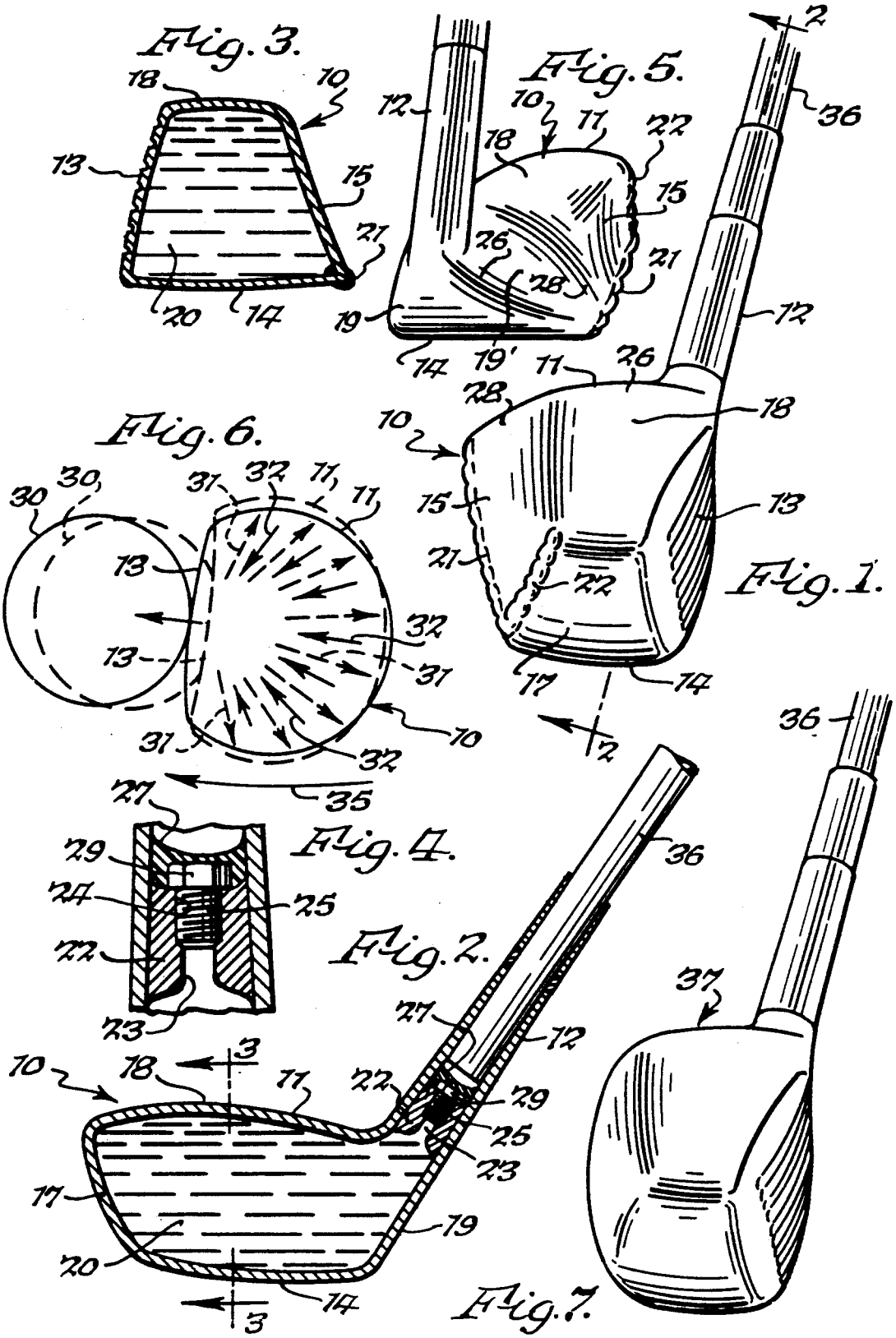
FIG. 1 is a fragmentary perspective view of the improved golf club head mounted on a shaft.
FIG. 2 is a fragmentary cross sectional view taken substantially along line 2—2 of FIG. 1 and showing the internal portion of the golf club head.
FIG. 3 is a cross sectional view taken substantially along line 3—3 of FIG. 2.
FIG. 4 is a fragmentary enlarged view of the plug portion of FIG. 2.
FIG. 5 is a fragmentary perspective view of the side of the club proximate the hosel.
FIG. 6 is a diagrammatic view showing the manner in which the golf club head acts during impact with a golf ball.
FIG. 7 is a fragmentary perspective view of the present invention embodied in the shape of a conventional golf club head.

Summarizing in advance, the improved golf club head 10 comprises a hollow body filled with a compressed fluid, and this combination acts as a liquid spring to provide both longer drives and an increased "sweet spot" ball-striking face on the club.

The improved golf club head 10 depicted in FIGS. 1-5 was fabricated by modifying a Wilson No. 1 metal wood. This modification was made for experimental purposes. However, it is preferred that the shape of the head should be of the conventional configuration, as shown in FIG. 7.

Golf club head 10 includes a hollow metal body 11 formed integrally with hosel 12 which receives shaft 36. Body 11 includes a ball striking face 13, a sole 14, a rear wall 15, an end wall 17, a top wall 18 and an end wall 19. The hollow metal body 11 contains compressed silicone oil 20 which, as noted above, causes the head 10 to act as a liquid spring upon impact of face 13 with a golf ball.

The hollow body 11 was fabricated in the following manner. A conventional Wilson metal wood had portions of its original end walls and its sole and its rear wall cut away. Its top wall 18 was then bent downwardly to form the rear wall shown at 15, and a weld line was applied at 21 to join rear wall 15 to sole 14. A weld line was also applied at 22 to join end wall 17 to rear wall 15. Weld lines 21 and 22 meet at the corner of the club. The end wall 19 included bends 26 and 28 with an intermediate slightly curved portion 19' therebetween. The reason that the size of the head 10 was reduced in the foregoing manner was to cause it to approximate the weight of the original air-filled unmodified metal wood after the reduced size head 10 was filled with silicone oil.

In order to fill the hollow body 11 with silicone oil 20 under pressure, the following procedure was followed. A plug of welding material 22 was welded into hosel 12. This plug was thereafter drilled at 23 and tapped at 24. Dow Corning Type 200 silicone oil having a viscosity of 1000 Centistokes at the ambient temperature of about 70° F. was then placed in dry ice, and its temperature was thus reduced to −60° F. The −60° F. silicone oil was then poured through drilled and tapped hole 24 to completely fill the club head. Thereafter, a plug 25 was threaded into tapped hole 24, and a seal of epoxy 27 was placed over the head 29 of the plug. When the silicone oil returned to an ambient temperature of 70° F., there was a temperature change in the silicone oil of 130° F. Based on the fact that there is a change in pressure of about 75 pounds per square inch per degree Fahrenheit of the confined silicone oil, it was calculated that the silicone oil was then under a pressure of about 9,750 pounds per square inch. At this pressure the silicone oil is compressible up to 7% by volume upon impact of a golf ball with the face 13 of the club, with the exact amount being dependent on the velocity of impact.

The theory of operation is depicted in FIG. 6 wherein the action is shown when head 10 strikes golf ball 30, and the direction of the stroke is depicted by arrow 35. The original shape of hollow body 11 both before and on the completion of impact is depicted in solid lines, and the flexing of hollow body 11 during striking of the ball is depicted in dotted lines. It will be appreciated that the club head 10 is initially stressed outwardly in tension because of the high pressure silicone oil contained therein. When the outwardly stressed yieldable club face 13 strikes ball 30, face 13 deflects from its solid line position toward its dotted line position. This causes the remainder of the hollow body 11 to deflect slightly from its solid line position 11 toward its dotted line position because the compressed silicone oil in the hollow body 11 is further compressed, and this compression is exerted equally in all directions on the internal surfaces of hollow body 11. The forces during impact are depicted by the dotted arrows 31. In addition, during impact the ball 30 oblongs from its perfectly solid line spherical shape toward its dotted line shape. On the completion of impact, the hollow body 11 returns to its solid line position, and the face 13 returns the spring energy of the expanding compressible fluid 20 to club face 13 which, in moving to its solid line position, returns its energy of compression back to ball 30 to thus impart a spring energy thereto from the expanding compressed silicone oil. The return of the head 11 to its original shape during the final phases of the ball striking action is depicted by solid arrows 32.

It will be appreciated that there can be numerous modifications within the scope of the foregoing disclosure. First of all, the plug 25 need not be located in the hosel as shown, but a suitable plug arrangement can be incorporated into the hollow body 11 itself, and, as such, if it is placed in the rear wall 15, it could also serve to provide a weight or balance to the club in this area. Furthermore, the plug which is used should preferably be a pipe type of plug which has a self sealing characteristic. Also, the pipe plug, if desired, can be placed in any portion of the hollow body 11 for balancing. Furthermore, the compressed silicone oil can be inserted into head 10 in any desired manner, which includes pumping it into the head under pressure.

In addition to the foregoing, it is contemplated that hollow body 11 need not be made of metal but can be fabricated of suitable plastics or resins which are sufficiently strong to withstand the forces to which a golf club is subjected.

Additionally, it is contemplated that the amount of compression to which the silicone oil is subjected can be varied so as to provide different characteristics for different classes of golfers. More specifically, stronger golfers could have higher compression heads than weaker golfers. This is analogous to having different compressions in golf balls wherein weaker golfers use lower compression balls.

Additionally, it is contemplated that the fluid which is used can be any compressible fluid including but not limited to other grades of silicone oil and freon.

In FIG. 7 there is shown a shape of a golf club head made in accordance with the principles of the present invention but the configuration is that of a conventional "pear-shaped" club.

While it is contemplated that the original amount of compression of the silicone oil can be as low as 5,000 pounds per square inch, it is contemplated that the initial compression can be anywhere up to about 15,000 pounds per square inch. However, during impact the silicone oil can have its pressure increased up to about 30,000 pounds per square inch depending on the velocity of impact. Also, the amount of compression of the silicone oil can be any value which gives the desired liquid spring action which returns the energy of impact to the ball. Thus, as noted above, when the silicone oil returns to its original pressure from its pressure at impact, the stored energy in the silicone fluid will aid in propelling the golf ball.

While preferred embodiments of the present invention have been disclosed, it will be appreciated that it is not limited thereto but may be otherwise embodied within the scope of the following claims.

What is claimed is:

1. A golf club head comprising a completely closed hollow body, a yieldable golf ball striking face on said hollow body, and pressurized compressible liquid means in said hollow body for pressurizing said hollow body and for being compressed when said yieldable golf ball striking face yields on the striking of a golf ball thereby.

2. A golf club head as set forth in claim 1 wherein said hollow body is fabricated of metal.

3. A golf club head as set forth in claim 1 wherein said compressible liquid is silicone oil.

4. A golf club head as set forth in claim 3 wherein said hollow body is fabricated of metal.

5. A golf club head as set forth in claim 4 including port means in said hollow body for filling said hollow body with said compressible liquid, and means for sealing said port means after said hollow body is filled with said compressible liquid.

6. A golf club head as set forth in claim 5 including a hollow shaft-receiving hosel on said hollow body, and said port means being located in said shaft-receiving hosel.

7. A golf club head as set forth in claim 3 wherein said silicone oil is under a pressure of at least 5,000 psi.

8. A golf club head as set forth in claim 3 wherein said silicone oil is under a pressure of about 10,000 psi.

9. A golf club head as set forth in claim 1 including a port means in said hollow body for filling said hollow body with said compressible liquid, and means for sealing said port means after said hollow body is filled with said compressible liquid.

10. A golf club head as set forth in claim 9 including a hollow shaft-receiving hosel on said hollow body, and said port means being located in said shaft-receiving hosel.

11. A golf club head as set forth in claim 10 wherein said sealable port means comprises a threaded port in said hosel, and wherein said means for sealing said port means comprises a threaded plug.

12. A golf club head as set forth in claim 11 including a sealing substance on said plug.

* * * * *

UNITED STATES PATENT AND TRADEMARK OFFICE

CERTIFICATE OF CORRECTION

PATENT NO. : 5,263,713

DATED : November 23, 1993

INVENTOR(S) : Douglas P. Taylor et al

It is certified that error appears in the above-identified patent and that said Letters Patent is hereby corrected as shown below:

Title page, item [57], In the Abstract, line 1, change "heat" to --head--.

Title page, item [57], In the Abstract, line 4, change "follow" to --hollow--.

Signed and Sealed this

Nineteenth Day of April, 1994

*Attest:*

*Attesting Officer*

BRUCE LEHMAN

*Commissioner of Patents and Trademarks*